United States Patent [19]

Gach

[11] Patent Number: 4,760,931

[45] Date of Patent: Aug. 2, 1988

[54] SAFETY CONTAINER NECK INSERT

[75] Inventor: Peter P. Gach, Evansville, Ind.

[73] Assignee: Sunbeam Plastics Corporation, Evansville, Ind.

[21] Appl. No.: 944,447

[22] Filed: Dec. 22, 1986

[51] Int. Cl.[4] ..... B65D 39/02

[52] U.S. Cl. ..... 215/235; 215/254; 220/258

[58] Field of Search ..... 215/235, 254, 255, 256, 215/363; 220/268, 270, 339, 337, 258

[56] References Cited

U.S. PATENT DOCUMENTS

| | | | |
|---|---|---|---|
| 710,219 | 9/1902 | Snow | 215/31 |
| 1,773,553 | 8/1930 | Taylor et al. | 215/363 X |
| 2,662,656 | 12/1953 | Beaubaire et al. | 215/51 |
| 3,164,306 | 1/1965 | Kitterman et al. | 220/339 X |
| 3,282,477 | 11/1966 | Henchert | 222/541 |
| 3,459,315 | 8/1969 | Labarre | 215/42 |
| 3,482,730 | 12/1969 | Podwalny | 220/337 |
| 3,532,248 | 9/1968 | Ruekberg | 220/54 |
| 3,567,061 | 3/1971 | Song | 220/27 |
| 3,782,583 | 1/1974 | Abbey | 220/339 |
| 4,059,201 | 11/1977 | Foster | 220/339 X |
| 4,203,529 | 5/1980 | Torassa et al. | 220/334 X |
| 4,452,382 | 6/1984 | Von Holdt | 222/529 |
| 4,453,646 | 6/1984 | Harrild | 220/258 |
| 4,572,397 | 2/1986 | Arens | 220/270 |

FOREIGN PATENT DOCUMENTS 882414 6/1943 France .

*Primary Examiner*—Donald F. Norton

*Attorney, Agent, or Firm*—Irvin L. Groh; Alfred L. Patmore, Jr.

[57] ABSTRACT

A container neck insert for providing a safety feature upon removal of a conventional covering cap. The insert is in the form of a plastic disk molded with a portion which engages a recess in the container neck and is retained therein. In one form the safety feature provides tamper indication by using a circumferential frangible opening line and a pull tab for removal of a portion of the disk. In another form, the safety feature provides child-resistant access to the container by acting as a pivoting door having a closing feature when the opening force is removed.

6 Claims, 2 Drawing Sheets

SAFETY CONTAINER NECK INSERT

This invention relates to safety closure-container packages, and, more particularly, to a container neck insert.

The more common safety features for closure-container packages generally relate to devices that make the container package tamper-proof or tamper-indicating or to elements which provide a degree of difficulty for a child to open, generally termed as child-resistant features. Normally these safety features are incorporated in the closure in the form a single or multiple piece cap having elements which cooperate with a stop located on the container neck below the threads used to afix the closure thereto. These safety closures can have a varying degree of complexity with a corresponding degree of intricacy of the forming molds and assembly procedures.

It is to the simplification of providing safety features for closure-container packages that this invention is directed.

The foregoing objective and other advantages are accomplished in providing the safety feature in the form of a container neck insert. This safety feature comes into play after the removal of a conventional lid from the container neck. The container neck is provided with a recess into which the insert in the form of a circular plastic disk is snapped. Ingress to the container is prevented without the movement of at least a portion of the insert disk relative to the container neck. The recess engaging portion of the disk remains stationary relative to the container neck.

In one form the container neck is provided with an internal peripheral groove which forms the recess, and the engagement means on the disk includes an annular area around the periphery of the disk. The disk can further include a pull tab attached to the disk adjacent to the inside of the annular engaging area and a circumferential groove between this pull tab and the engagement area to provide a frangible break line and a central removable area. Ingress to the container is obtained by exerting a force on the pull tab to remove the central area which provides evidence of tampering or prior opening.

In another form, the insert disk with a peripheral engagement area can have its central portion severed from the peripheral portion except for a hinge portion which allows the central portion to pivot inwardly to gain ingress to the container. This provides a child-resistant feature to the closure-container package. Preferably, in this instance, the swinging central portion or door has a return to closing position feature which can be provided by the resilience and design of the hinge or by a separate swing element and cooperating reaction peg separately located on the engaging portion of the disk and the central door portion adjacent the hinge.

Another type of swinging door child-resistant safety insert can be provided where the container neck has opposed axial directed slots and the disk is constructed with opposed hinged ears projecting outwardly from a central door area for engagement in these slots to act as a door which pivots about a diameter of the disk. The insert may be made from a resilient material so that the hinge ears act as a torsion hinge to return the insert door to a closing position upon the removal of an opening force.

The preferred embodiments of the invention are illustrated in the drawing in which.

Figure 6:
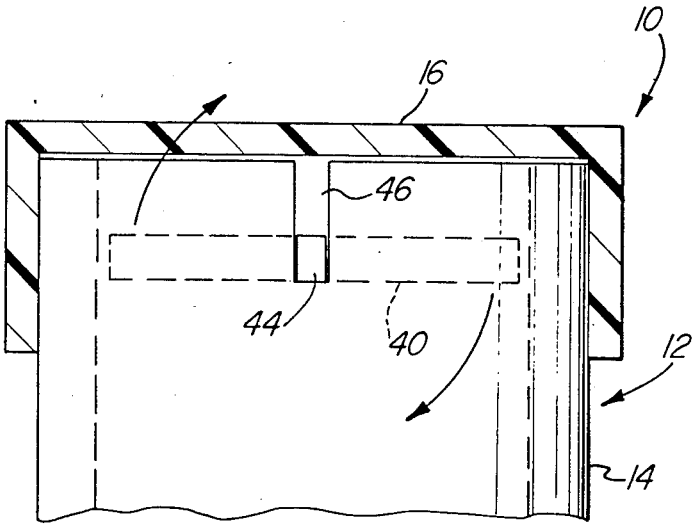
Figure 7:
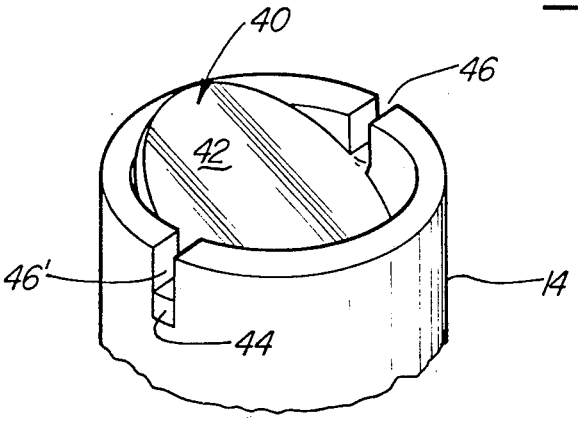

FIG. 6 is an elevational view in partial cross-section showing another embodiment of the insert of this invention providing a child-resistant pivoting door in which the disk is attached to the container neck by projecting hinge ears on the disk which engage axially directed opposed slots in the container neck; and FIG. 7 is a perspective view with a portion broken away of the insert and container neck of FIG. 6.

Figure 1:
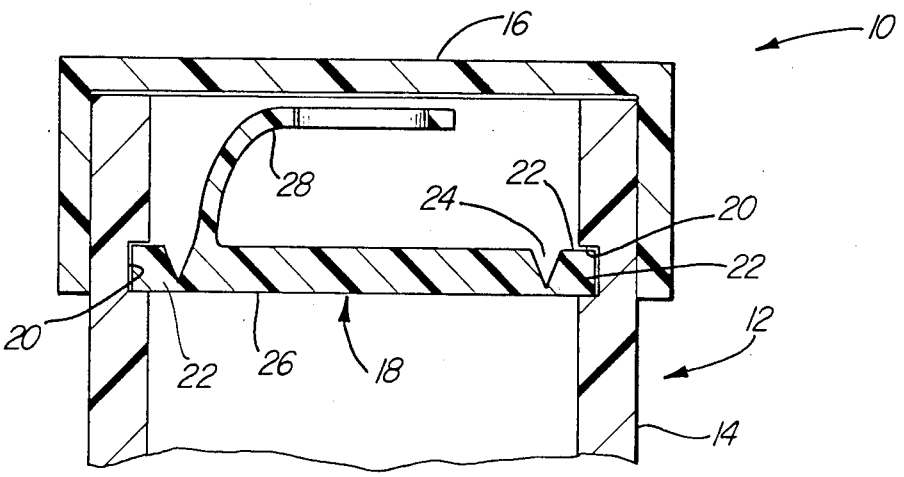
FIG. 1 is an elevational view in partial cross-section showing the insert of this invention engaged in an internal peripheral groove in the container neck and designed to provide tamper indication by requiring manual removal of a central portion thereof to gain ingress to the container.
Figure 2:
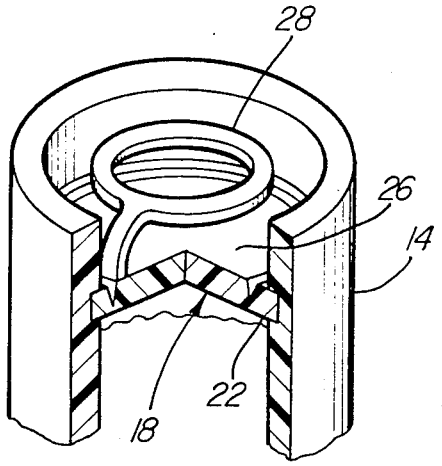
FIG. 2 is a perspective view with a portion broken away of the insert and container neck of FIG. 1.

Referring to FIGS. 1 and 2 safety package 10 is seen as including container 12 the neck of which is shown at 14, cover cap 16 and the insert 18 of this invention. Container neck 14 can be of a plain cylindrical configuration with no threads, and cover cap 16 may be a simple push on type cap, or the neck and cap can be threaded or provided with snap flanges or the like. The container neck 14 is provided with an internal circumferential groove 20. Insert 18 is molded as a plastic disk in circular form having an annular area 22 around its periphery for engagement with all three sides of disk container groove 20. Radially inwardly of the engagement area 22 a peripheral groove 24 is formed to provide a frangible break line which also defines a radially inwardly removable circular area 26. A pull tab 28 is provided inwardly and adjacent to groove 24 attached to the removable area 26. Ingress to the container is obtained by removal of cap 16 and exerting a force on pull tab 28 to remove the central area 26. Insert 18 is molded integrally with its central area 26, its peripheral engagement area 22, its groove 24 and pull tab 28. Material such as polyethlyene is used to provide sufficient flexibility for snap insertion of the disk 18 within the container groove 22 but still provide a clean break at groove 24 when an opening force is asserted on pull tab 28. Package integrity can be easily ascertained by the removal of cap 16 and observation of the condition or absence of sealing disk 18. When the circular area 26 has been completely removed, the presence of the remaining engagement area 22 gives evidence of tampering or prior opening. Disk 18 can be molded in a different contrasting color to enhance its tamper-indicating function.

Figure 3:
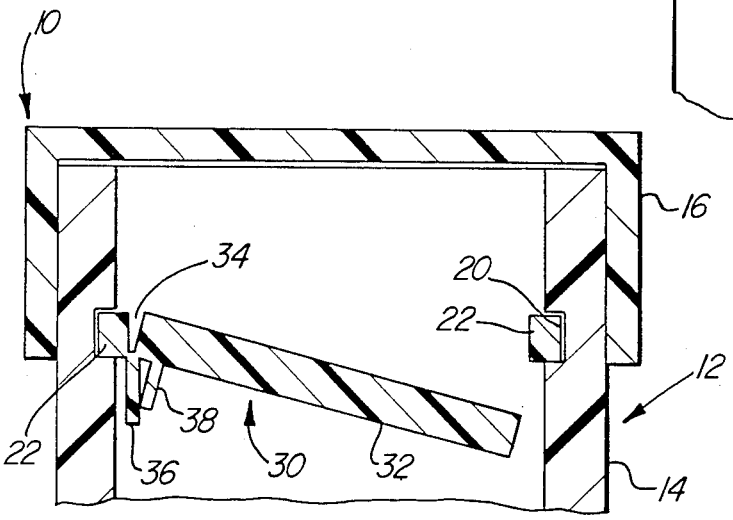
FIG. 3 is an elevational view in partial cross-section showing another type of insert engaged in an internal peripheral groove in the container neck designed to provide child-resistant access to the container by a door portion.
Figure 4:
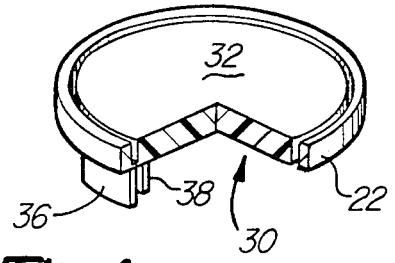
FIG. 4 is a perspective view with a portion broken away of the insert and container neck of FIG. 3.
Figure 5:
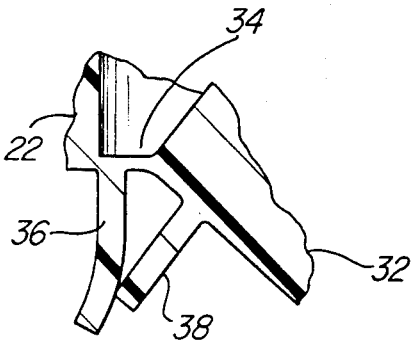
FIG. 5 is an enlarged fragmentary sectional view showing the details of the hinge and spring back closing feature applied to the insert of FIGS. 3 and 4.

Referring to FIGS. 3–5 another form of the safety package 10 is illustrated with an insert 30 formed as a circular disk having an annular peripheral engagement area 22 for engagement with peripheral container groove 20 in the same manner as insert 18 of the embodiment shown in FIGS. 1 and 2. Central disk area 32 serving as an access door is attached to the peripheral engagement area 22 by hinge 34. Access to the container is obtained by exerting a downward force on cover 32 providing a child-resistant feature. Cover 32 returns to its closing position by the design of hinge 34, or it may have a separate spring return as depicted in detail in FIG. 5. Here spring member 36 is attached to the peripheral engagement area 22 or forms a part of the hinge 34 for coaction with a stiffer peg element 38.

The saftey package 10 of FIGS. 6 and 7 utilizes an insert 40 to also provide a child-resistant pivoting door 42. Here disk 40 is molded as a circular disk 42 with hinge ears 44 projecting from diametrically opposed portions of central cover 42 for engagement in diametrically opposed axially directed slots or grooves 46 in container neck 14. Insert 40 can be molded using a resilient plastic material such as polypropolyene so that hinge ears 44 act as torsion bars in container grooves 46 to return the cover to its closing position. Like the child-resistant door 32 of FIGS. 3–5, access to the container is obtained by exerting a downward force on cover 42 to pivot the cover about the axis of hinge ears 44.

In each of the three illustrated embodiments of this invention the peripheral bottle neck engaging portion of the insert remains in contact with the container neck and movement of at least the central portion of the insert must be instituted to provide ingress to the container. The simple circular disk shape of the insert is easily molded with a uncomplicated die, and the container neck is easily provided with an internal peripheral groove or slot or opposed axial grooves or slots.

The embodiments of the invention in which an exclusive property or priviledge is claimed are defined as follows:

1. In combination with a container, an insert for providing a safety feature when a lid is removed from the container, said container having a cylindrical neck portion with an internal peripheral groove forming a recess therein, and said insert comprising: a circular plastic disk with an annular area around the periphery thereof for engaging said container neck recess to prevent ingress to the container without movement of a central portion of said disk relative to said container neck about a hinge joining the central portion and annular area of said disk, said annular area remaining in position in said neck recess when the central portion is moved for ingress to said container , and spring means adjacent said hinge returning said central portion to its original position preventing ingress to the container when an opening force is removed.

2. In combination with a container, an insert for providing child-resistant access to the container, said container having a cylindrical neck portion with an internal circumferential groove, and said insert comprising: a ring having an outer peripheral portion for engagement in said container groove and an inner portion projecting into said container neck when the ring is engaged in said groove; a circular disk within said ring; a hinge joining said disk and said inner ring portion allowing pivoting movement of said disk relative to said ring providing access to the container by exerting an opening force on said disk to pivot it inwardly of said container and means for returning said disk to a closed position within said ring when said opening force is removed, said means including a projecting spring member on one of said inner ring portion and said disk adjacent said hinge and a reaction peg on the other of said inner ring portion and said disk adjacent said hinge in cooperative engagement with said spring member.

3. The combination according to claim 2 wherein said ring, disk, and hinge are integrally molded.

4. The combination according to claim 2 wherein said ring, disk, hinge, spring member, and reaction peg are integrally molded.

5. In combination with a container, an insert for providing child-resistant access to the container, said container having a cylindrical neck portion with diametrically opposed axially directed slots therein, and said insert comprising a circular disk; and a pair of hinge ears projecting outwardly from said disk on diametrically opposed sides of said disk for engagement with said container neck slots, said insert being made from a resilient plastic material so that said hinge ears act as a torsion hinge to return the insert to its closing position upon removal of an opening force; whereby access to said container is obtained by exerting a force on said disk to pivot it about said hinge ears.

6. A safety package comprising a container, a lid, and a tamper indicating insert, said container having a neck providing access to the contents of said container, said neck having an internal circumferential groove and a surface for engagement by said lid to close said access, said lid being in engagement with said neck and said insert comprising: a circular plastic disk having an annular engagement ring at its periphery for engagement in said container groove; a circumferential line of weakening in said disk inwardly and adjacent said annular engagement ring creating a central circular removable access area; and a pull tab connected to said disk in said access area adjacent to the circumferential line of weakening, whereby access to said container is obtained by removing said lid and exerting a force on said pull tab to remove the access area of said disk leaving the annular engagement ring in said container groove as evidence of prior tampering or prior opening.

* * * * *